US008573305B2

(12) United States Patent
Reddy

(10) Patent No.: US 8,573,305 B2
(45) Date of Patent: Nov. 5, 2013

(54) PULL-HEAD RELEASE MECHANISM FOR BEND STIFFENER CONNECTOR

(75) Inventor: Sanjay K. Reddy, Houston, TX (US)

(73) Assignee: Deep Sea Technologies, Inc., Houston, TX (US)

( * ) Notice: Subject to any disclaimer, the term of this patent is extended or adjusted under 35 U.S.C. 154(b) by 128 days.

(21) Appl. No.: 12/842,361

(22) Filed: Jul. 23, 2010

(65) Prior Publication Data

US 2011/0094748 A1 Apr. 28, 2011

Related U.S. Application Data

(60) Provisional application No. 61/228,431, filed on Jul. 24, 2009.

(51) Int. Cl.
*E21B 7/12* (2006.01)

(52) U.S. Cl.
USPC ..... 166/343; 166/338; 166/341; 166/345

(58) Field of Classification Search
USPC ..... 166/338, 339, 341, 342, 343, 344, 345
See application file for complete search history.

(56) References Cited

U.S. PATENT DOCUMENTS 3,032,125 A 5/1962 Hiser et al.
3,332,484 A 7/1967 Watkins
3,486,556 A 12/1969 Burgess
3,695,350 A * 10/1972 Petersen ..... 405/169
3,846,992 A * 11/1974 Liautaud ..... 405/169
4,024,718 A 5/1977 Roche et al.
4,133,182 A 1/1979 Chateau
4,893,677 A 1/1990 Brammer et al.
5,279,369 A 1/1994 Brammer
5,794,700 A 8/1998 Pollack
6,098,715 A 8/2000 Seixas et al.
6,220,303 B1 4/2001 Secher et al.
6,336,508 B1 1/2002 Guinn
6,688,930 B2 2/2004 Cottrell et al.
7,032,673 B2 4/2006 Dezen et al.

(Continued)

OTHER PUBLICATIONS

Flotation Technologies InFlex bend limiters product web page (www.flotec.com/flo24.html), date unknown, 2 pages.

(Continued)

*Primary Examiner* — Matthew Buck
*Assistant Examiner* — Aaron Lembo
(74) *Attorney, Agent, or Firm* — Meyertons, Hood, Kivlin, Kowert & Goetzel, P.C.; Eric B. Meyertons

(57) ABSTRACT

An automatic release system for a riser includes a guide funnel assembly that receives a shaft coupled to the riser. A pull-head is located inside at least a portion of the shaft and coupled to the shaft. The pull-head is coupled to a pulling mechanism. One or more spring-loaded dogs are mounted on the outside of the shaft. The dogs radially move in and out through one or more openings in the shaft aligned with the dogs and engage a groove on the pull-head when radially moved in through the openings. One or more stopper mechanisms are mounted on the outside of the shaft and aligned with the dogs. In a first position, the stopper mechanisms inhibit the dogs from disengaging from the groove in the pull-head. In a second position, the stopper mechanisms allow the dogs to disengage from the groove in the pull-head.

18 Claims, 9 Drawing Sheets

(56) References Cited

U.S. PATENT DOCUMENTS

| | | | |
|---|---|---|---|
| 7,044,228 | B2 | 5/2006 | Langford et al. |
| 7,143,830 | B2 | 12/2006 | Bartlett |
| 7,467,662 | B2 | 12/2008 | Smith |
| 7,503,391 | B2 | 3/2009 | McCanna et al. |
| 2004/0226722 | A1 | 11/2004 | Colyer et al. |
| 2005/0269102 | A1 | 12/2005 | McCanna et al. |
| 2008/0087435 | A1 | 4/2008 | Reddy |

OTHER PUBLICATIONS

U.S. Patent and Trademark Office, "Office Communication," for U.S. Appl. No. 11/776,826 mailed Apr. 13, 2010.

U.S. Patent and Trademark Office, "Office Communication," for U.S. Appl. No. 11/776,826 mailed Jan. 5, 2011.

* cited by examiner

PULL-HEAD RELEASE MECHANISM FOR BEND STIFFENER CONNECTOR

PRIORITY CLAIM

This patent application claims priority to U.S. Provisional Patent No. 61/228,431 entitled "PULL-HEAD RELEASE MECHANISM FOR BEND STIFFENER CONNECTOR" to Reddy filed on Jul. 24, 2009.

BACKGROUND

1. Field of the Invention

The present invention relates to subsea connectors and devices for limiting the bend of flexible pipes or umbilicals used with subsea connections. More particularly, the invention relates to devices used to distribute loads during pull-in operations associated with the bend limiting devices.

2. Description of Related Art

Bend restrictors (or bend limiters) and/or bend stiffeners are used to inhibit overbending of flexible pipes or cable, flowline, and/or umbilical risers where the risers attach to fixed or floating structures such as, but not limited to, subsea riser bases, wellhead connections, pipeline end manifolds (PLEMs), and fixed or floating offshore platforms. The flexible pipes, flowlines, and/or umbilicals may be used, for example, to transport hydrocarbons or other fluids, to and from the surface. As an example, a bend restrictor/limiter may be used to inhibit overbending of an umbilical riser exiting an I-tube or J-tube on an offshore platform.

A bend restrictor/limiter may fit snugly over the riser and be tapered on the outside with a passage on the inside to allow the riser to pass through the bend restrictor/limiter. One end of the bend restrictor/limiter may be coupled to (e.g., secured or attached to) the riser base (e.g., the I-tube or J-tube) while the other end is freely moving. This structure allows the riser to move axially within the bend restrictor/limiter while lateral movement of the riser is inhibited by engaging the inside walls of the bend restrictor/limiter.

The riser may move laterally due to forces such as current or wave action. The stiffness provided by the bend restrictor/limiter limits the curvature of the riser and ensures that the curvature stays within a maximum curvature allowed by the design of the riser. This curvature limitation protects the riser from overbending and/or kinking.

In some subsea operations, the bend restrictor/limiter includes two parts: a guide funnel assembly and a shaft assembly. The guide funnel assembly may be pre-installed on a subsea structure such as an I-tube or J-tube. The shaft assembly may be installed on the riser prior to installation of the riser (e.g., the shaft assembly is installed with the riser at the time of offshore installation).

Typically, a holdback clamp assembly is installed on the riser below the shaft assembly. The holdback clamp assembly prevents the shaft assembly and the bend restrictor/limiter from slipping during pull-in operations (e.g., pull-in of the riser into the guide funnel assembly). The holdback clamp assembly may transfer the pull-in load of the shaft assembly and push the shaft assembly into the guide funnel assembly to engage the assemblies together. The installation loads may be transferred from the holdback clamp assembly into the end of the bend restrictor/limiter and onto the shaft assembly during pull-in operations. In certain cases, the installation loads may be high and the end of the bend restrictor/limiter may be damaged due to the high installation loads (e.g., when there are large angular misalignments between the shaft assembly and the guide funnel assembly during pull-in operations).

System designs using the holdback clamp assembly also require the holdback clamp assembly to be removed by a remotely operated vehicle (ROV) or diver after the shaft assembly is latched into the guide funnel assembly for pull-in operations to continue. Thus, there is a need for a system for a bend restrictor/limiter that better distributes loads in the system to avoid damage to the bend restrictor/limiter during pull-in operations. The system may include an automatic release mechanism to appropriately distribute loads within the shaft assembly and a pull-head during pull-in operations.

SUMMARY

In certain embodiments, an automatic release system for a riser coupled to a bend restrictor/limiter includes a guide funnel assembly. The guide funnel assembly may receive a shaft. The shaft may be coupled to the riser. The shaft may be received inside the guide funnel assembly. A pull-head may be located inside at least a portion of the shaft and coupled to the shaft. The pull-head may couple to a pulling mechanism. The pulling mechanism may pull the shaft and the riser into the guide funnel assembly.

In certain embodiments, the automatic release system includes one or more spring-loaded dogs mounted on the outside of the shaft. The dogs may radially move in and out through one or more openings in the shaft aligned with the dogs. The dogs may engage a groove on the pull-head when radially moved in through the openings. Pulling loads on the pull-head may be transferred to the dogs when the dogs engage the groove on the pull-head.

In certain embodiments, the automatic release system includes one or more stopper mechanisms mounted on the outside of the shaft and aligned with the dogs. In a first position, the stopper mechanisms may inhibit the dogs from disengaging from the groove in the pull-head. The stopper mechanisms may be moved into a second position by being contacted with the guide funnel assembly when the shaft is pulled a selected distance into the guide funnel assembly. In the second position, the stopper mechanisms may allow the dogs to disengage from the groove in the pull-head.

BRIEF DESCRIPTION OF THE DRAWINGS

Features and advantages of the methods and apparatus of the present invention will be more fully appreciated by reference to the following detailed description of presently preferred but nonetheless illustrative embodiments in accordance with the present invention when taken in conjunction with the accompanying drawings in which.

Figure 1:
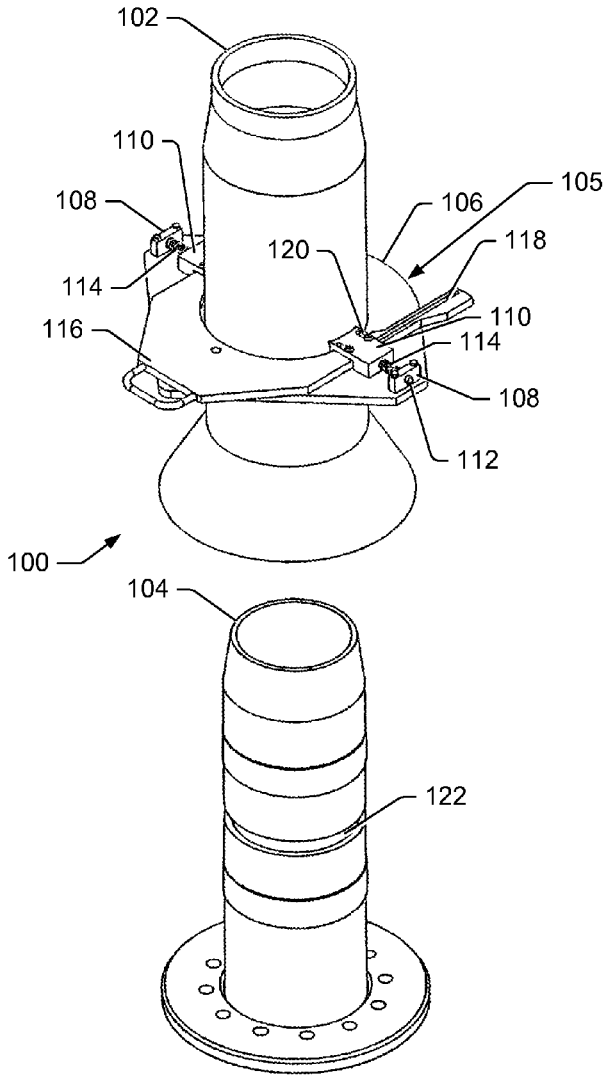
FIG. 1 depicts a representation of an embodiment of a connector that may be used for connecting bend restrictors/limiters to a structure in a subsea environment.

While the invention is susceptible to various modifications and alternative forms, specific embodiments thereof are shown by way of example in the drawings and will herein be described in detail. The drawings may not be to scale. It should be understood that the drawings and detailed description thereto are not intended to limit the invention to the particular form disclosed, but to the contrary, the intention is to cover all modifications, equivalents and alternatives falling within the spirit and scope of the present invention as defined by the appended claims.

DETAILED DESCRIPTION OF EMBODIMENTS

In the context of this patent, the term "coupled" means either a direct connection or an indirect connection (e.g., one or more intervening connections) between one or more objects or components. The phrase "directly connected" means a direct connection between objects or components such that the objects or components are connected directly to each other so that the objects or components operate in a "point of use" manner.

In the context of this patent, the terms "latching dog" and "dog" refer to any mechanical device for holding, gripping, and/or fastening that comprises a spike, bar, hook, deadbolt, pin, or the like. The term "bend restrictor/limiter" refers to both a bend restrictor/limiter and a bend stiffener. Thus, a connector for a bend restrictor/limiter is also a connector for a bend stiffener and vice versa.

Figure 1A:
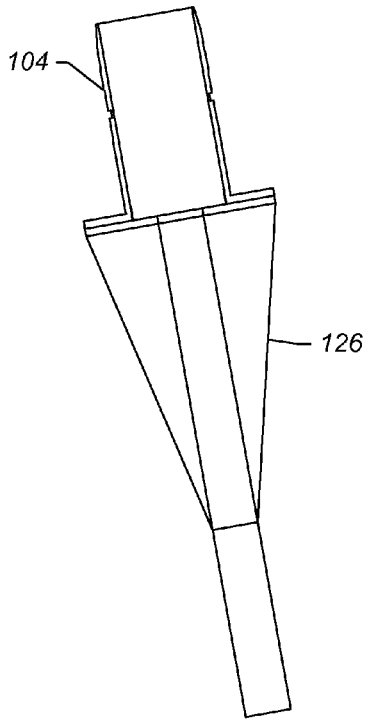
FIG. 1A depicts a representation of an embodiment of a shaft coupled to a bend restrictor/limiter.

FIG. 1 depicts a representation of an embodiment of connector 100 that may be used for connecting bend restrictors/limiters and/or bend stiffeners to a structure in a subsea environment. Connector 100 includes guide funnel assembly 102 and shaft 104. Assembly 102 and shaft 104 may have shapes that allow the shaft to be received in the assembly (e.g., the shaft can be inserted into the interior volume of the assembly). In certain embodiments, assembly 102 is coupled to a subsea portion of a fixed or floating structure (e.g., an offshore platform or a subsea riser base). For example, assembly 102 may be coupled to an end of an I-tube or J-tube flange on an offshore platform. Assembly 102 may be coupled to the structure, for example, by either bolting or welding the assembly to the structure. In certain embodiments, shaft 104 is coupled to a bend restrictor/limiter. FIG. 1A depicts a representation of an embodiment of shaft 104 coupled to bend restrictor/limiter 126. Shaft 104 may be coupled to bend restrictor/limiter 126, for example, by bolting or welding the shaft to the bend restrictor/limiter. In the embodiment depicted in FIG. 1, assembly 102 is configured to be welded to the structure and shaft 104 is configured to be bolted to the bend restrictor/limiter.

In certain embodiments, latch assembly 105 is coupled to assembly 102. In certain embodiments, latch assembly 105 includes base plate 106, cam plate 116, and/or other components described herein that operate to couple assembly 102 to shaft 104. Base plate 106 may be substantially flat or be of another suitable shape. In certain embodiments, base plate 106 is welded to assembly 102. Spring retainers 108 may be coupled to base plate 106. Spring retainers 108 may, for example, be bolted or otherwise attached to base plate 106.

Assembly 102 may include one or more slots in the side of the assembly to allow latching dogs 110 to slide in and out through the walls of the assembly. The slots may be machined or otherwise formed in the side of assembly 102. In certain embodiments, assembly 102 includes two slots on opposite sides of the assembly.

Dogs 110 may be guided by guides 112. Guides 112 may be shoulder bolts and/or other suitable devices for guiding dogs 110. Shoulder bolts may be screwed into dogs 110 to secure the bolts to the dogs. Examples of other suitable devices for guides that may be used in combination with shoulder bolts or instead of shoulder bolts include, but are not limited to, screws, slots, pins, springs, and grooves.

Guides 112 may pass through spring retainers 108. Springs 114 may be installed over guides 112 so that the springs lay between spring retainers 108 and dogs 110. Springs 114 may provide a biasing force between spring retainers 108 and dogs 110 that urges the dogs radially inwards towards walls of assembly 102. Springs 114 are compressed as dogs 110 slide out of the slots in the side of assembly 102. In some embodiments, other biasing devices may be used in combination with springs 114 or instead of the springs.

In certain embodiments, cam plate 116 slidably couples to base plate 106. Cam plate 116 may mate to the shape and/or surface of base plate 106 so that the cam plate and the base plate are slidably engaged. Cam plate 116 may be used to control movement of dogs 110. In some embodiments, multiple cam plates and/or other suitable structures are used to control the movement of dogs. Other suitable structures include, but are not limited to, hydraulic pistons, gears, and cranks. Additionally, cam plate 116 and/or other suitable structures for moving dogs 110 may be coupled to base plate 106 and/or assembly 102 in ways other than shown in FIG. 1 that may facilitate operation of the dogs.

Cam plate 116 controls the radial movement of dogs 110 on assembly 102 so that the cam plate controls the sliding of the dogs in and out of the slots on the sides of the assembly. In certain embodiments, cam plate 116 includes grooves or slots 118 shaped into the legs of the cam plate. Slots 118 may slidably couple to guides 120 (e.g., shoulder bolts or other suitable structures) attached to base plate 106. Guides 120 may also slidably couple dogs 110 to base plate 106. Dogs 110 may have an interior slot through which legs of cam plate 116 are received. Guides 120 may guide the radial inward and outward movement of dogs 110 while allowing and guiding radial movement of cam plate 116 towards and away from assembly 102.

In certain embodiments, cam plate 116 includes three cam surfaces on the legs of the cam plate. In some embodiments, other numbers of cam surfaces are included on the surfaces of the cam plate and/or the legs of the cam plate. The cam surfaces may engage the interior of the slots on dogs 110 to control the radial position of the dogs. In certain embodiments, the three cam surfaces are used to position dogs 110 in three different positions. The three positions: the "install position" depicted in FIGS. 2-4; the "lock position" depicted in FIG. 5; and the "remove position" depicted in FIG. 6.

Figure 6:
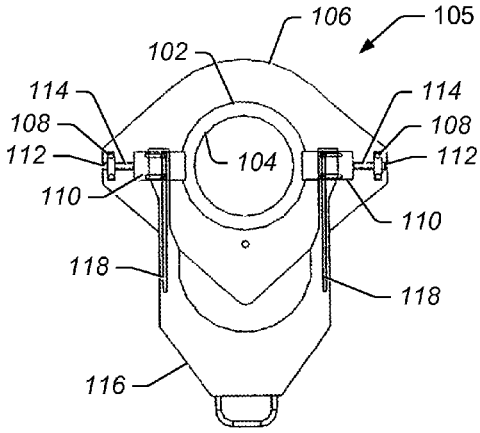
FIG. 6 depicts a top view of an embodiment of a connector in the remove position.

In certain embodiments, the legs of cam plate 116 have first cam surfaces on outer sides of the legs and at or near the ends of the legs that are used to move dogs 110 radially outwards for the remove position (shown in FIG. 6). Adjacent second cam surfaces on the outer sides of the legs of cam plate 116 are used for the install position (depicted in FIGS. 2-4). The second cam surfaces in the install position allow dogs 110 to move radially inward to follow the outer surface of shaft 104 as the shaft moves along the inside of assembly 102. Dogs 110 may lock into a desired position on shaft 104 when the dogs engage one or more grooves on the shaft. Assembly 102 is secured to shaft 104 when dogs 110 lock into the desired position.

Third cam surfaces are located on the opposite side of the first cam surfaces on the legs of cam plate 116. The third cam surfaces are disposed on the inward sides of the legs (the sides closest to assembly 102). The third cam surfaces force dogs 110 inwards to a locked position when cam plate 116 is moved radially towards assembly 102 (e.g., towards the lock position depicted in FIG. 5).

Figure 5:
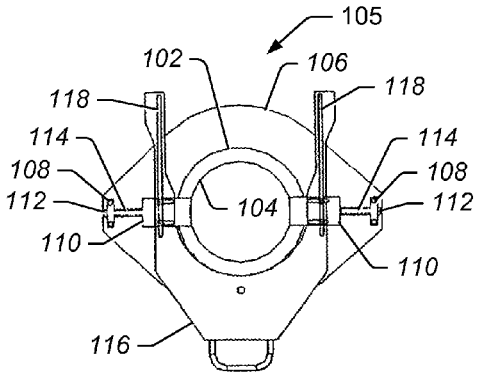
FIG. 5 depicts a top view of an embodiment of a connector in the lock position.

Inward movement of cam plate 116 may be limited or stopped when an inner surface of the cam plate presses against assembly 102 (e.g., when cam plate 116 reaches the lock position depicted in FIG. 5). Outward movement of cam plate 116 may be limited or stopped by the end of the slots or grooves in the legs of the cam plate so that the cam plate cannot be pulled off assembly 102 (e.g., when cam plate 116 reaches the remove position depicted in FIG. 6).

In some embodiments, connector 100 and its associated components such as, but not limited to, cam plate 116, assembly 102, and shaft 104 include visual markings, colors, and/or other visual enhancements as desired so that an operator of an ROV ("remotely operated vehicle") may easily view the position and/or operation of the connector including operation of the cam plate. In some embodiments, cam plate 116 includes a handle, latch, or other grasping device that is easily engaged by the ROV so that the ROV may easily move and/or operate the cam plate, which controls operation of dogs 110. In some embodiments, cam plate 116 is coupled to a screw drive, torque device (e.g., torque bucket), or other mechanical device that facilitates the movement and/or operation of the cam plate and dogs 110. Such devices may be operated by the ROV to move and/or operate cam plate 116.

In certain embodiments, shaft 104 includes recess 122 (depicted in FIG. 1). Recess 122 may include grooves, holes, slots, notches, or other suitable recesses on the outer surface of the shaft so that dogs 110 can extend into the recess when assembly 102 is properly aligned with the shaft. When dogs 110 are extended into recess 122, shaft 104 is locked into position within assembly 102.

Figure 2:
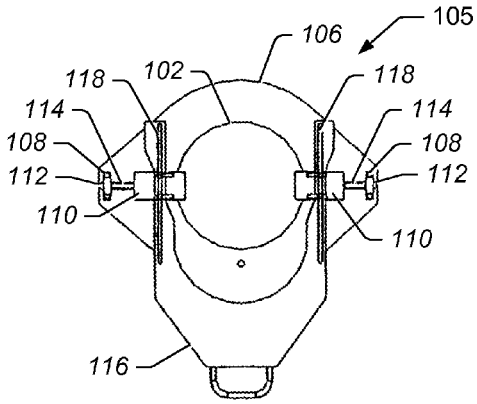
FIG. 2 depicts a top view of an embodiment of a connector in the install position before a shaft is inserted into an assembly.
Figure 3:
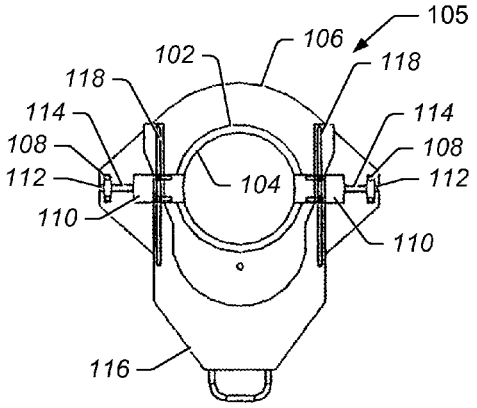
FIG. 3 depicts a top view of an embodiment of a connector in the install position as a shaft is being inserted into an assembly.
Figure 4:
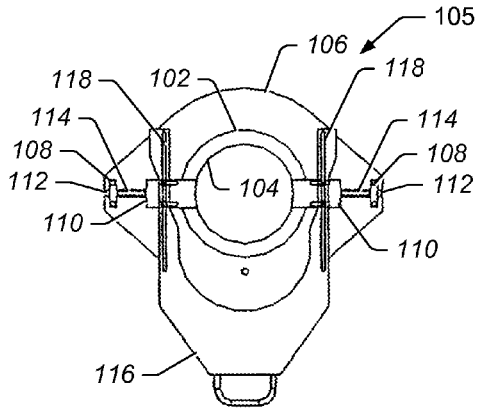
FIG. 4 depicts a top view of an embodiment of a connector in the install position with a shaft fully inserted into an assembly.
Figure 7:
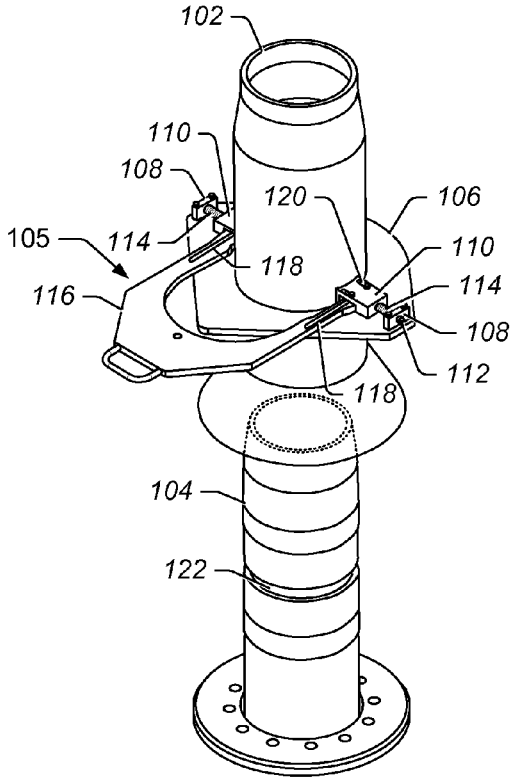
FIG. 7 depicts a representation of an embodiment of a connector in the install position before a shaft is inserted into an assembly.
Figure 8:
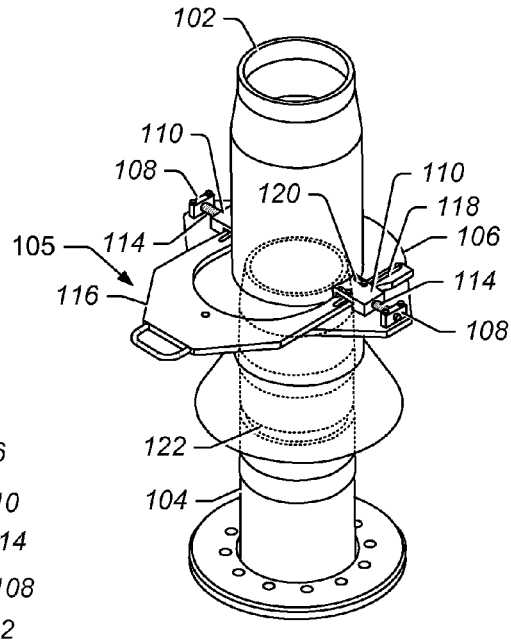
FIG. 8 depicts a representation of an embodiment of a connector in the install position as a shaft is being inserted into an assembly.

FIGS. 2-4 and 7-9 depict embodiments of connector 100 in the install position. FIGS. 2 and 7 depict an embodiment of connector 100 in the install position before shaft 104 is inserted into assembly 102. In the install position, cam plate 116 is positioned such that dogs 110 are free to move in and out of the slots on assembly 102 within the limits of guides 120. Springs 114 provide tension to extend dogs 110 into the slots on assembly 102. FIGS. 3 and 8 depict an embodiment of connector 100 in the install position as shaft 104 is being inserted into assembly 102. Dogs 110 move back and forth while following the outer surface profile of shaft 104 as the shaft is inserted into assembly 102. FIG. 4 depicts an embodiment of connector 100 in the install position with shaft 104 fully inserted into assembly 102 and dogs 110 snap into the recess on the shaft due to the force of springs 114.

Figure 9:
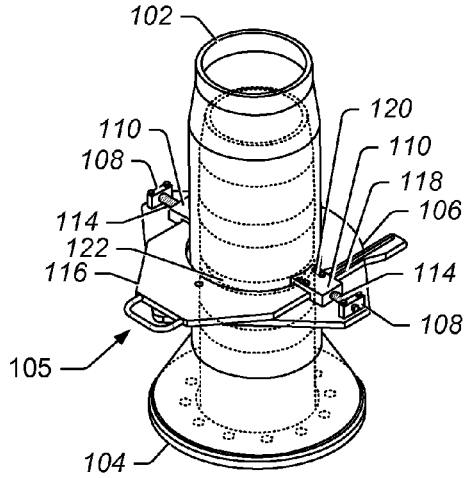
FIG. 9 depicts a representation of an embodiment of a connector in the lock position.

After dogs 110 snap into recess 122 on shaft 104, cam plate 116 may be moved to the lock position. FIGS. 5 and 9 depict an embodiment of connector 100 in the lock position. In FIGS. 5 and 9, cam plate 116 has been moved inward towards shaft 104 along guides 118 so that dogs 110 are locked into place. In the lock position, dogs 110 are inhibited from retracting out of the recess on shaft 104 by the third cam surfaces on the legs of cam plate 116. In the lock position, longitudinal axial movement between shaft 104 and assembly 102 is inhibited (e.g., the shaft and the assembly, as depicted in FIG. 9, are inhibited from moving up and down relative to each other).

To unlock and remove shaft 104 from assembly 102, cam plate 116 is moved to the remove position. FIG. 6 depicts an embodiment of connector 100 in the remove position. Cam plate 116 is moved (e.g., pulled) to the position shown in FIG. 6 by, for example, an arm of the ROV. In this position, springs 114 are compressed and dogs 110 are moved out of the recess on shaft 104. Moving dogs 110 out of the recess allows assembly 102 and shaft 104 to be pulled apart.

In certain embodiments, the weight of the bend restrictor/limiter, shaft 104, and any associated couplings is taken up by dogs 110. When lateral loads act on the riser, bending loads are transmitted through shaft 104 into assembly 102 due to the close tolerance between the shaft and the assembly. Contact points between shaft 104 and assembly 102 may be located on either side of the location of dogs 110.

In some alternative embodiments, other mechanisms than those described above are used for securing (e.g., latching) shaft 104 inside assembly 102. In one embodiment, a hinged circular ring with dogs 110 coupled on the inside of the ring replaces cam plate 116. An open end of the ring may be coupled together by a screw drive. The screw drive may be operated (e.g., actuated) by the ROV manipulator or a torque tool to drive the dogs.

In some embodiments, hard rubber dogs may be used instead of and/or in combination with metal (e.g., steel) dogs in the above-described latching assemblies or in other similar operating assemblies. The hard rubber dogs may provide vibration dampening for connector 100.

In some embodiments, a circular or ring-shaped cam plate with interior cam surfaces that act similarly to the cam surfaces described above may be used in latch assembly 105. The interior cam surfaces may act to drive the dogs through one or all of the positions described above (e.g., the install, lock, and/or remove positions). Rotation of such a cam plate may move the dogs through the various positions.

In some embodiments, a cam plate may be shaped as a ring or otherwise shaped so that when the cam plate is moved up and down parallel to the longitudinal axis of assembly 102, the cam plate operates to latch and unlock the dogs as described above.

In some embodiments, a clamp, a three-part clamp, a plate, a sliding lock, or any other suitable locking device may be used instead of and/or in combination with dogs 110 in latch assembly 105.

While cam surfaces have been described herein as devices for operating dogs 110. It is to be understood that other devices such as, but not limited to, worm gears, drive nuts, torque drives, handles, and/or other mechanical drives that can be operated by the ROV may be used. Additionally, while three positions are shown herein (install, lock, and remove), not all these positions are necessary in all embodiments described herein and/or other positions may be designed into the operation of connector 100 and used as desired.

It is to be understood the installation of connector 100 is not limited to particular methods (e.g., installation without divers or installation by the ROV) described above which may, of course, vary. Other methods and/or equipment known in the art or developed for use in the art may be used to install and operate connector 100 and latch assembly 105 without divers.

Figure 10:
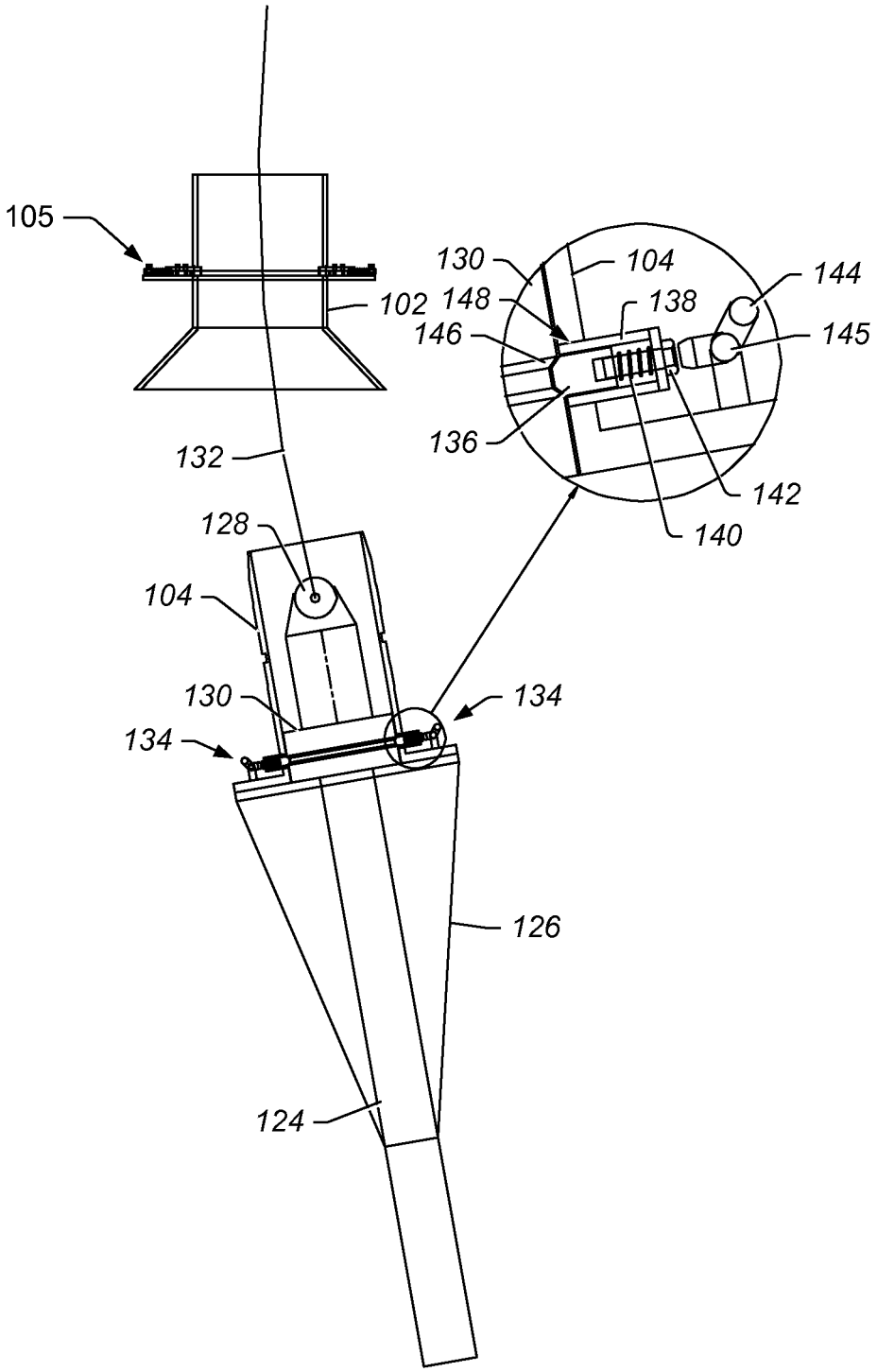
FIG. 10 depicts a representation of an embodiment of a guide funnel assembly and shaft coupled to a riser with a bend restrictor/limiter used during pull-in operations in a subsea environment.

In certain embodiments, connector 100 is used during pull-in operations of a riser or bend restrictor/limiter coupled to shaft 104 (e.g., pull-in of the riser and shaft 104 into guide funnel assembly 102). FIG. 10 depicts a representation of an embodiment of guide funnel assembly 102 and shaft 104 coupled to riser 124 and bend restrictor/limiter 126 used during pull-in operations in a subsea environment. In certain embodiments, assembly 102 is coupled to a subsea portion of a fixed or floating structure (e.g., an offshore platform or a subsea riser base). For example, assembly 102 may be coupled to an end of an I-tube or J-tube flange on an offshore platform. Assembly 102 may be coupled to the structure, for example, by either bolting or welding the assembly to the structure. In some embodiments, assembly 102 is pre-installed on the structure. Shaft 104 may be coupled to riser 124 and bend restrictor/limiter 126, for example, by bolting or welding the shaft to the riser and/or the bend restrictor/limiter. In some embodiments, shaft 104 is coupled to riser 124 and/or bend restrictor/limiter 126 prior to installation of the riser and/or bend restrictor/limiter (e.g., the shaft is coupled to the riser and/or bend restrictor/limiter at the time of offshore installation).

In certain embodiments, for pull-in operation, pull-head 128 is coupled to riser 124. Pull-head 128 may be located inside shaft 104. Adapter 130 may locate pull-head 128 inside shaft 104. In certain embodiments, adapter 130 is part of pull-head 128. In some embodiments, adapter 130 is a separate piece coupled to pull-head 128.

During pull-in operation, cable 132 may be coupled to pull-head 128 and the assembly coupled to the pull-head (e.g., shaft 104, riser 124, bend restrictor/limiter 126, etc.). Cable 132 may be run from, for example, the deck of a platform and run through assembly 102 and the structure coupled to the assembly (e.g., an I-tube or J-tube). Cable 132 may be coupled to pull-head 128 by a diver or using an installation vessel such as an ROV or other subsea tool.

In certain embodiments, one or more dog assemblies 134 are coupled to shaft 104. An enlarged view of one dog assembly 134 is shown in the detailed view inset of FIG. 10. Dog assemblies 134 may be, for example, mounted (e.g., welded) on the outside of shaft 104. In one embodiment, three dog assemblies 134 are coupled to shaft 104. The three dog assemblies may be substantially equally spaced around the pipe of shaft 104 (e.g., the dog assemblies are spaced at intervals of approximately 120° around the pipe of the shaft).

In certain embodiments, dog assembly 134 includes dog 136, dog case 138, spring 140, fastener 142, and stopper mechanism 144. Fastener 142 may be a bolt or other suitable fastener coupled to dog 136. Fastener 142 may be spring loaded inside dog case 138 using spring 140. Dog cases 138 may be mounted (e.g., welded) to shaft 104, as shown in the inset of FIG. 10.

Shaft 104 may include openings 148 at the locations of dog cases 138. Openings 148 in shaft 104 may be sized to allow dogs 136 to penetrate through the wall of the shaft and contact pull-head adapter 130. In certain embodiments, pull-head adapter 130 includes groove 146. Groove 146 is designed to match the shape of ends of dogs 136. Thus, when dogs 136 extend into matching groove 146, the dogs engage pull-head adapter 130 and latch pull-head 128 in place inside shaft 104.

In certain embodiments, stopper mechanisms 144 are mounted (e.g., welded) on shaft 104 near the ends of fasteners 142. Stopper mechanisms 144 may be movable between one or more positions. For example, stopper mechanisms 144 may be rotatable about hinged axis 145 (shown in the detailed view insert of FIG. 10). In a first position (shown in the detailed view insert of FIG. 10), stopper mechanisms 144 inhibit fasteners 142 from retracting and, thus, dogs 136 from retracting (disengaging) out of groove 146.

During pull-in operation of riser 124, the installation or pull-in loads may be relatively high and/or unpredictable. With the use of dog assemblies 134, the pull-in loads are transferred from pull-head 128 to dogs 136. Stopper mechanisms 144 inhibit dogs 136 from being disengaged by the pull-in loads. Transferring the pull-in loads from pull-head 128 to dogs 136 reduces the potential for damage to shaft 104, riser 124, and/or bend restrictor/limiter 126.

Figure 11:
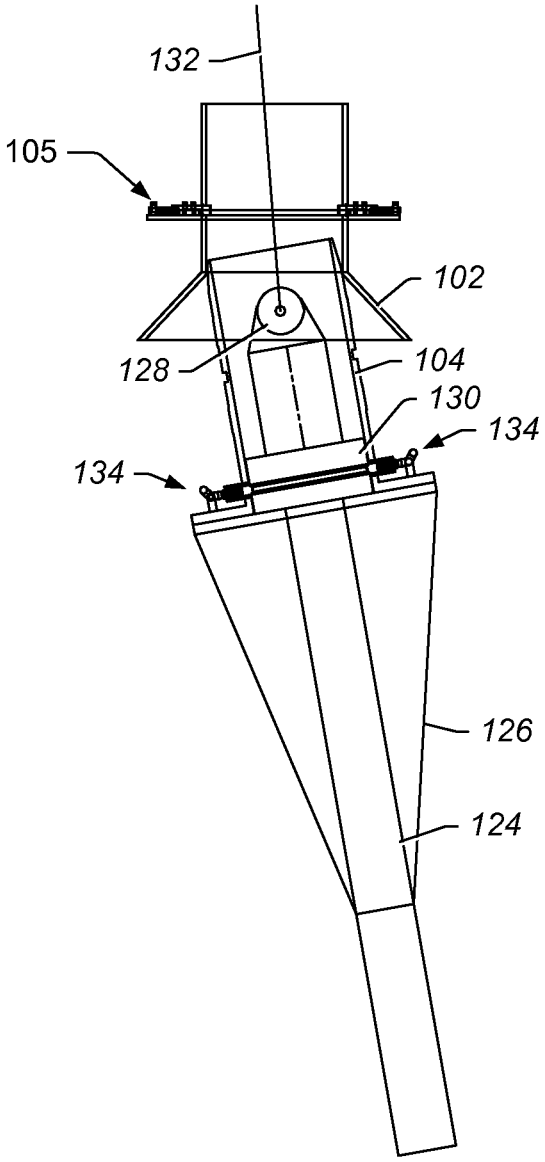
FIG. 11 depicts a representation of a shaft as the shaft enters a guide funnel assembly during a pull-in operation.

FIGS. 11-15 depict various stages during a pull-in operation. FIG. 11 depicts a representation of shaft 104 as the shaft enters assembly 102 during the pull-in operation. Shaft 104 is pulled into assembly 102 using cable 132 attached to pull-head 128. Cable 132 may be pulled using, for example, a pulling mechanism. A small degree of misalignment between shaft 104 and assembly 102 is shown in FIG. 11.

Figure 12:
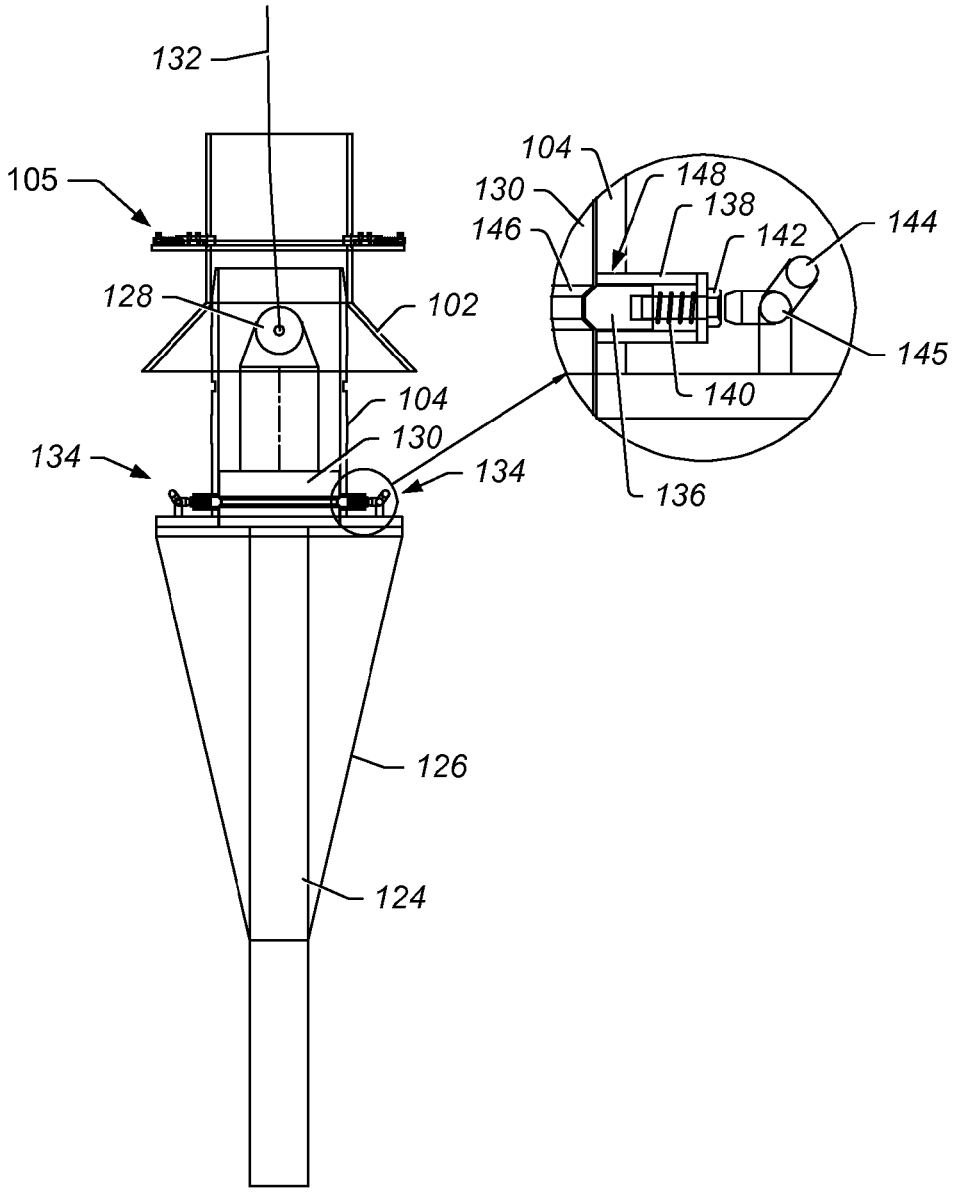
FIG. 12 depicts a representation of a shaft and a guide funnel assembly during the pull-in operation after the shaft and the guide funnel assembly are aligned.
Figure 13:
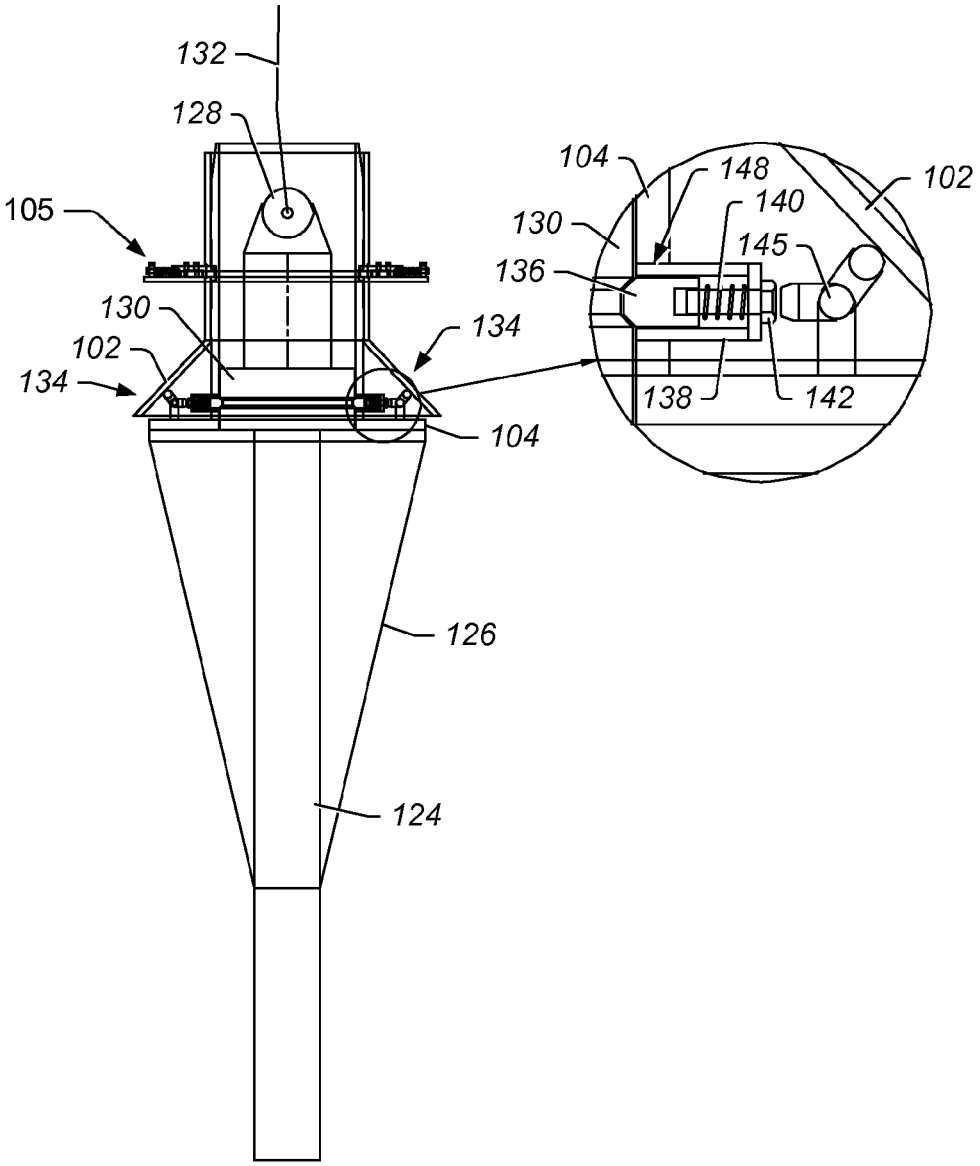
FIG. 13 depicts a representation of a shaft and a guide funnel assembly during the pull-in operation as the guide funnel assembly begins to contact stopper mechanisms.

FIG. 12 depicts a representation of shaft 104 and assembly 102 during the pull-in operation after the shaft and assembly are aligned. As shown in the inset of FIG. 12, stopper mechanisms 144 remain in the first position inhibiting retraction of fasteners 142 and dogs 136. FIG. 13 depicts a representation of shaft 104 and assembly 102 further pulled in during the pull-in operation such that the assembly begins to contact stopper mechanisms 144 (shown in the detailed view insert of FIG. 13).

Figure 14:
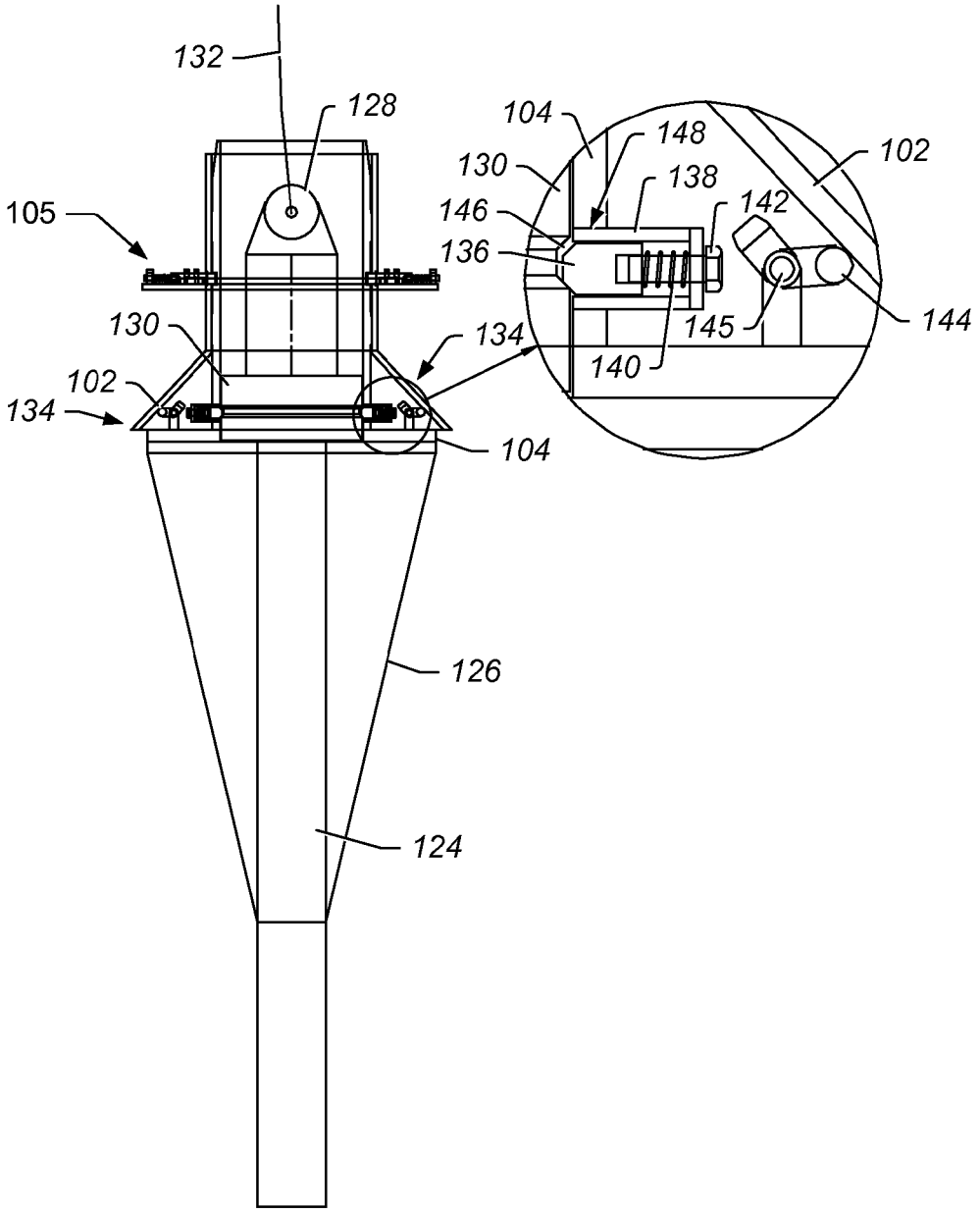
FIG. 14 depicts a representation of a shaft and a guide funnel assembly pulled closer together during the pull-in operation such that the guide funnel assembly begins to pivot stopper mechanisms into a second position.

FIG. 14 depicts a representation of shaft 104 and assembly 102 pulled closer together during the pull-in operation such that the assembly begins to pivot stopper mechanisms 144 into a second position. As shown in the detailed view insert of FIG. 14, assembly 102 pushes down on an end of stopper mechanism 144 such that the stopper mechanism rotates (pivots) about axis 145 and the stopper mechanism is moved into the second position and out of the way of fastener 142. Thus, dogs 136 are unlocked from groove 146 on pull-head adapter 130. At this time during the pull-in operation, the pull-in loads are lower and more predictable than earlier during the pull-in operation (e.g., while shaft 104 and assembly 102 are misaligned). The pull-in loads at this time during the pull-in operation may be calculated and predicted using techniques known in the art. The pull-in loads during this point of the pull-in operation may be taken up by springs 140. Springs 140 may be designed to not compress more than the depth of the groove 146 based on the predicted loads.

Figure 15:
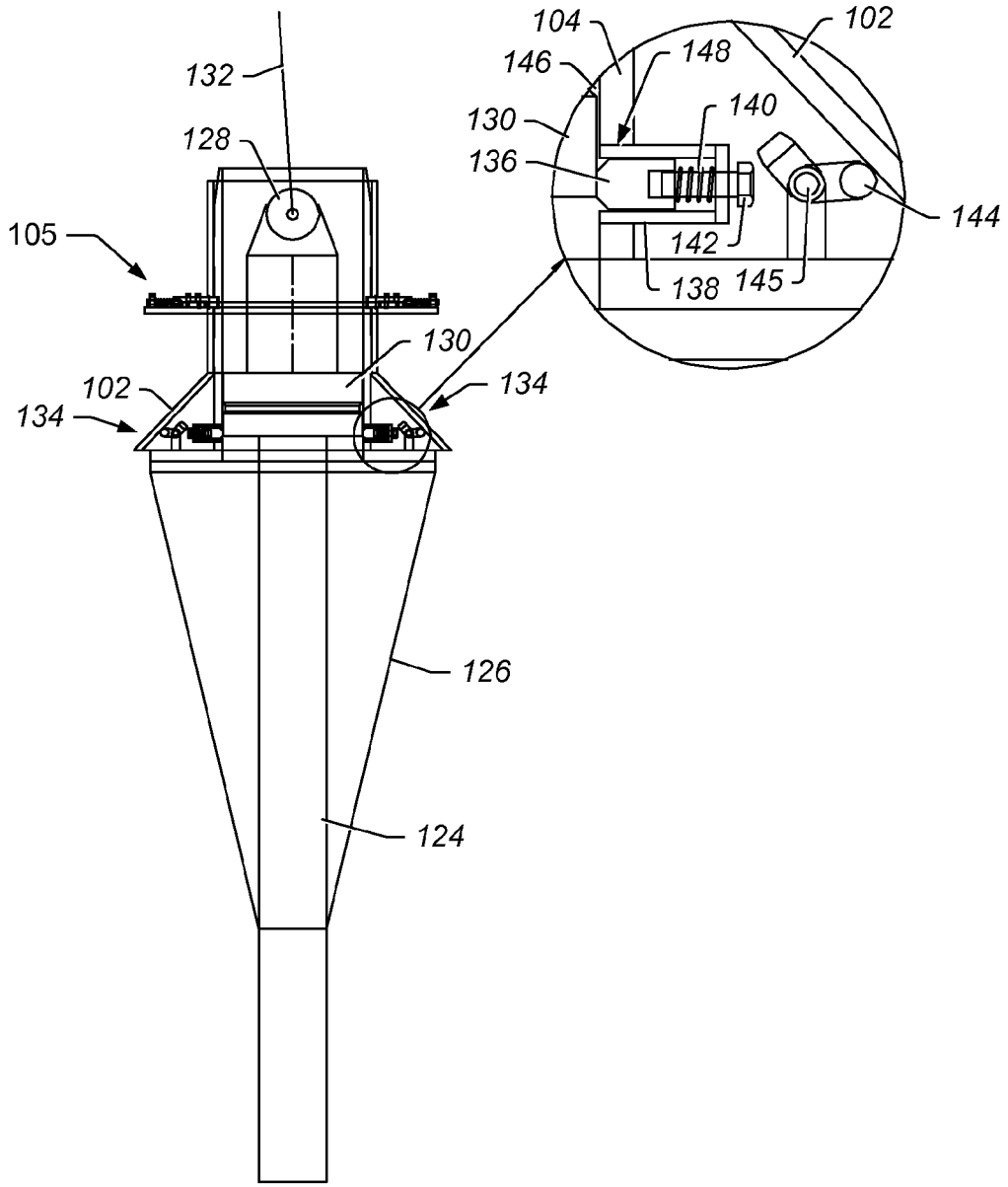
FIG. 15 depicts a representation of a shaft and a guide funnel assembly pulled together near the end of the pull-in operation such that dogs are pushed out of a groove on a pull-head.

As shaft 104, using pull-head 128, is pulled further into assembly 102 near the end of the pull-in operation, additional pull load may be applied to the pull-head to compress springs 140 sufficiently such that dogs 136 are pushed out of groove 146 on pull-head adapter 130, as shown in FIG. 15. Because stopper mechanisms 144 are in the second position, the stopper mechanisms do not inhibit movement of dogs 136 out of groove 146 (disengagement of the dogs). When dogs 136 are disengaged from pull-head adapter 130 and pull-head 128, the pull-head takes up any loads on the system. The use of dog assemblies 134 provides an automated release mechanism for shaft 104 and pull-head 128 during the pull-in operation depicted in FIGS. 11-15.

It is to be understood the invention is not limited to particular systems described which may, of course, vary. It is also to be understood that the terminology used herein is for the purpose of describing particular embodiments only, and is not intended to be limiting. As used in this specification, the singular forms "a", "an" and "the" include plural referents unless the content clearly indicates otherwise. Thus, for example, reference to "a spring" includes a combination of two or more springs.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. An automatic release system for a riser coupled to a bend restrictor/limiter, comprising:

a guide funnel assembly configured to receive a shaft;

the shaft configured to be coupled to the riser and configured to be received inside the guide funnel assembly;

a pull-head located inside at least a portion of the shaft and coupled to the shaft, wherein the pull-head is coupled to a pulling mechanism, and wherein the pulling mechanism pulls the shaft and the riser into the guide funnel assembly during use; and one or more spring-loaded dogs mounted on an outside of the shaft, wherein the dogs radially move in and out through one or more openings in the shaft aligned with one or more of the spring-loaded dogs and engage a groove on the pull-head when radially moved in through one or more of the openings, and wherein pulling loads on the pull-head are transferred to one or more of the spring-loaded dogs when the spring-loaded dogs engage the groove on the pull-head;

wherein the groove on the pull-head is located on an adapter coupled to the pull-head, and wherein the adapter locates the pull-head inside the shaft.

2. An automatic release system for a riser coupled to a bend restrictor/limiter, comprising:

a guide funnel assembly configured to receive a shaft;

the shaft configured to be coupled to the riser and configured to be received inside the guide funnel assembly;

a pull-head located inside at least a portion of the shaft and coupled to the shaft, wherein the pull-head is coupled to a pulling mechanism, and wherein the pulling mechanism pulls the shaft and the riser into the guide funnel assembly during use;

one or more stopper mechanisms mounted on an outside of the shaft and aligned with one or more spring-loaded dogs mounted on the outside of the shaft, wherein, in a first position, one or more of the stopper mechanisms inhibit one or more of the spring-loaded dogs from disengaging from a groove in the pull-head, wherein one or more of the stopper mechanisms are moved into a second position by being contacted with the guide funnel assembly when the shaft is pulled a selected distance into the guide funnel assembly, and wherein, in the second position, one or more of the stopper mechanisms allow one or more of the spring-loaded dogs to disengage from the groove in the pull-head;

wherein the groove on the pull-head is located on an adapter coupled to the pull-head, and wherein the adapter locates the pull-head inside the shaft.

3. An automatic release system for a riser coupled to a bend restrictor/limiter, comprising:

a guide funnel assembly;

a shaft configured to be coupled to the riser and configured to be received inside the guide funnel assembly;

a pull-head located inside at least a portion of the shaft and coupled to the shaft, wherein the pull-head is configured to couple to a pulling mechanism; and one or more stopper mechanisms mounted on an outside of the shaft, wherein the stopper mechanisms rotate when the guide funnel assembly contacts the stopper mechanisms as the shaft is pulled into the guide funnel assembly during use.

4. The system of claim 1, wherein a majority of the pull-head is located inside the shaft.

5. The system of claim 1, further comprising:

a latch assembly coupled to the guide funnel assembly, the latch assembly comprising one or more latch assembly dogs and a latch operating device;

wherein the latch assembly dogs are radially moveable in and out of the interior of the guide funnel assembly, and wherein the latch assembly dogs are configured to be inserted into a recess on the shaft to inhibit longitudinal axial movement between the shaft and the guide funnel assembly; and wherein the latch operating device is configured to control the in and out radial movement of the latch assembly dogs.

6. The system of claim 2, wherein a majority of the pull-head is located inside the shaft.

7. The system of claim 2, wherein the stopper mechanisms rotate from the first position to the second position when the guide funnel assembly contacts the stopper mechanisms.

8. The system of claim 2, wherein the dogs radially move in and out through one or more openings in the shaft aligned with one or more of the spring-loaded dogs and engage the groove on the pull-head when radially moved in through one or more of the openings.

9. The system of claim 2, further comprising:

a latch assembly coupled to the guide funnel assembly, the latch assembly comprising one or more latch assembly dogs and a latch operating device;

wherein the latch assembly dogs are radially moveable in and out of the interior of the guide funnel assembly, and wherein the latch assembly dogs are configured to be inserted into a recess on the shaft to inhibit longitudinal axial movement between the shaft and the guide funnel assembly; and wherein the latch operating device is configured to control the in and out radial movement of the latch assembly dogs.

10. The system of claim 3, further comprising one or more spring-loaded dogs mounted on the outside of the shaft and aligned with the one or more stopper mechanisms.

11. The system of claim 10, wherein one or more of the stopper mechanisms inhibit one or more of the spring-loaded dogs from disengaging from a groove on the pull-head until one or more of the stopper mechanisms are contacted by the guide funnel assembly as the shaft is pulled into the guide funnel assembly during use, at which time, one or more of the stopper mechanisms allow one or more of the spring-loaded dogs to disengage from the groove in the pull-head.

12. An automatic release system for a riser coupled to a bend restrictor/limiter, comprising:

a guide funnel assembly configured to receive a shaft;

the shaft configured to be coupled to the riser and configured to be received inside the guide funnel assembly;

a pull-head located inside at least a portion of the shaft and coupled to the shaft, wherein a majority of the pull-head is located inside the shaft, wherein the pull-head is coupled to a pulling mechanism, and wherein the pulling mechanism pulls the shaft and the riser into the guide funnel assembly during use;

one or more stopper mechanisms mounted on an outside of the shaft and aligned with one or more spring-loaded dogs mounted on the outside of the shaft, wherein, in a first position, one or more of the stopper mechanisms inhibit one or more of the spring-loaded dogs from disengaging from a groove in the pull-head, wherein one or more of the stopper mechanisms are moved into a second position by being contacted with the guide funnel assembly when the shaft is pulled a selected distance into the guide funnel assembly, and wherein, in the second position, one or more of the stopper mechanisms allow one or more of the spring-loaded dogs to disengage from the groove in the pull-head.

13. The system of claim 12, wherein the dogs radially move in and out through one or more openings in the shaft aligned with one or more of the spring-loaded dogs and engage the groove on the pull-head when radially moved in through one or more of the openings.

14. The system of claim 12, further comprising:

a latch assembly coupled to the guide funnel assembly, the latch assembly comprising one or more latch assembly dogs and a latch operating device;

wherein the latch assembly dogs are radially moveable in and out of the interior of the guide funnel assembly, and wherein the latch assembly dogs are configured to be inserted into a recess on the shaft to inhibit longitudinal axial movement between the shaft and the guide funnel assembly; and wherein the latch operating device is configured to control the in and out radial movement of the latch assembly dogs.

15. An automatic release system for a riser coupled to a bend restrictor/limiter, comprising:

a guide funnel assembly configured to receive a shaft;

the shaft configured to be coupled to the riser and configured to be received inside the guide funnel assembly;

a pull-head located inside at least a portion of the shaft and coupled to the shaft, wherein the pull-head is coupled to a pulling mechanism, and wherein the pulling mechanism pulls the shaft and the riser into the guide funnel assembly during use;

one or more stopper mechanisms mounted on an outside of the shaft and aligned with one or more spring-loaded dogs mounted on the outside of the shaft, wherein, in a first position, one or more of the stopper mechanisms inhibit one or more of the spring-loaded dogs from disengaging from a groove in the pull-head, wherein one or more of the stopper mechanisms are moved into a second position by being contacted with the guide funnel assembly when the shaft is pulled a selected distance into the guide funnel assembly, and wherein, in the second position, one or more of the stopper mechanisms allow one or more of the spring-loaded dogs to disengage from the groove in the pull-head;

wherein the stopper mechanisms rotate from the first position to the second position when the guide funnel assembly contacts the stopper mechanisms.

16. The system of claim 15, wherein the dogs radially move in and out through one or more openings in the shaft aligned with one or more of the spring-loaded dogs and engage the groove on the pull-head when radially moved in through one or more of the openings.

17. The system of claim 15, further comprising:

a latch assembly coupled to the guide funnel assembly, the latch assembly comprising one or more latch assembly dogs and a latch operating device;

wherein the latch assembly dogs are radially moveable in and out of the interior of the guide funnel assembly, and wherein the latch assembly dogs are configured to be inserted into a recess on the shaft to inhibit longitudinal axial movement between the shaft and the guide funnel assembly; and wherein the latch operating device is configured to control the in and out radial movement of the latch assembly dogs.

18. An automatic release system for a riser coupled to a bend restrictor/limiter, comprising:

a guide funnel assembly;

a shaft configured to be coupled to the riser and configured to be received inside the guide funnel assembly;

a pull-head located inside at least a portion of the shaft and coupled to the shaft, wherein the pull-head is configured to couple to a pulling mechanism;

one or more stopper mechanisms mounted on an outside of the shaft; and one or more spring-loaded dogs mounted on the outside of the shaft and aligned with the one or more stopper mechanisms;

wherein one or more of the stopper mechanisms inhibit one or more of the spring-loaded dogs from disengaging from a groove on the pull-head until one or more of the stopper mechanisms are contacted by the guide funnel assembly as the shaft is pulled into the guide funnel assembly during use, at which time, one or more of the stopper mechanisms allow one or more of the spring-loaded dogs to disengage from the groove in the pull-head.

* * * * *